US005456356A

United States Patent [19]

Kurzawa

[11] Patent Number: 5,456,356

[45] Date of Patent: Oct. 10, 1995

[54] TOILET PLUNGER ACCESSORY

[76] Inventor: Raymond W. Kurzawa, 1851 Bataan St., Joliet, Ill. 60435

[21] Appl. No.: 356,641

[22] Filed: Dec. 15, 1994

[51] Int. Cl.[6] ..... A45C 11/00; A47B 81/02

[52] U.S. Cl. ..... 206/349; 206/225; 206/394; 4/255.11; 4/661; D6/551

[58] Field of Search ..... 4/255.01, 661, 4/225.11; D6/515, 518, 520–524, 551; D28/63, 73; 312/42, 45, 306, 307; 242/55.42; 206/216, 225, 349, 389, 394, 457; 248/110, 111, 314

[56] References Cited

U.S. PATENT DOCUMENTS

| | | | |
|---|---|---|---|
| D. 206,135 | 12/1966 | O'Neil | D6/551 |
| D. 207,099 | 3/1967 | Johnson et al. | D6/524 |
| D. 229,650 | 12/1973 | Sonnergaard | D6/521 |
| D. 248,069 | 6/1978 | Robles | D6/521 |
| D. 286,962 | 12/1986 | Ruiz | D6/523 |
| 1,110,533 | 9/1914 | Carmichael | 206/15.2 |
| 3,450,452 | 6/1969 | Reid | 312/206 |
| 4,008,933 | 2/1977 | Wanek | 312/206 |
| 4,192,561 | 3/1980 | Gunn | 312/206 |
| 4,211,750 | 7/1980 | Gillespie | 248/110 |
| 4,432,451 | 2/1984 | Hooser | 312/206 |
| 5,040,679 | 8/1991 | Rehmann | 206/457 |
| 5,335,374 | 8/1974 | Wilk et al. | 4/255.11 |
| 5,353,442 | 10/1994 | Rotter | 4/255.11 |

FOREIGN PATENT DOCUMENTS

| | | | |
|---|---|---|---|
| 622195 | 6/1961 | Canada | 206/15.2 |

*Primary Examiner*—Charles E. Phillips
*Attorney, Agent, or Firm*—Laff, Whitesel, Conte & Saret, Ltd.

[57] ABSTRACT

A combination toilet plunger cover and toilet tissue roll holder having an elongate cylinder connected to a lower, preferably frusto-conical shaped, housing with a cavity within the cylinder and housing of sufficient size to accommodate a plunger therein and the cylinder having an outer diameter of sufficient size to accommodate a plurality of toilet paper rolls stacked thereon. A base plate may also be provided with the cover to form a kit which prevents drainage of a wet plunger onto a floor.

2 Claims, 1 Drawing Sheet

TOILET PLUNGER ACCESSORY

BACKGROUND OF THE INVENTION

The present invention relates to bathroom accessories for use with toilet plungers and/or rolls of toilet paper.

Several containers have been patented which are useful for storage of one or more rolls of toilet tissue. Representative of such containers are U.S. Pat. Nos.: 2,534,290; 3,275,133; 4,192,561; and 4,273,392.

U.S. Pat. No. 2,534,290 (Moskowitz) describes a container for stacked rolls of toilet tissues and the like having a cover with an endless tape encircling a stack of tissue rolls. The tape is connected to the cover for raising the stack of rolls concomitant with the act of raising the cover.

U.S. Pat. No. 3,275,133 (Wood) describes a bathroom tissue roll dispenser having a tubular housing with a rigid insert having top and bottom disks connected by opposing rigid side strips. A handle on the top disk allows the insert to be removed upwardly from the housing thereby allowing access to rolls of toilet tissue stacked within the insert.

U.S. Pat. No. 4,192,561 (Gunn) describes a storage container for roll tissue paper having a tubular housing of sufficient diameter to enclose a stack of tissue rolls. The housing contains a post having a circular base whereby rolls are stacked upon the post with the post being inserted through the tubular core of each roll. Rolls may be accessed from the housing by grasping the post and lifting the post and stacked rolls from the interior of the housing.

U.S. Pat. No. 4,273,392 (Stinson) describes a tissue roll holder having a support rod and bottom plate for holding the rolls in a stacked vertical array within an elongated cylindrical housing.

Also, a bathroom accessory has been described as being in the form of a canister for storage of both a plurality of toilet tissue rolls and a suction type plunger device as shown in U.S. Pat. No. 4,432,451.

U.S. Pat. No. 4,432,451 (Hooser) describes a canister device for storage of toilet tissue rolls and a toilet plunger. This device comprises a cylindrical enclosure housing having a downwardly extending slot, inwardly located tray support means, a movable tray member supported by the tray support means. The tray member has a lug which extends outwardly of the housing slot so that the tray member may be lifted to remove rolls of toilet tissue. The tray member, tray support means and housing have openings to accommodate passage therethrough of a plunger device as described within the patent.

Disadvantageously all of the above patents describe relatively complex multi-component devices. All of these inventions are designed to substantially enclose and hide from view stacked rolls of toilet tissue. Only one of the above patents contemplates the possibility of storing both a toilet plunger and a plurality of tissue rolls viz U.S. Pat. No. 4,432,451 (Hooser). It would be advantageous to provide an inexpensive, attractive, easy to use and manufacture device for convenient storage with ready access of both a toilet plunger and a plurality of toilet tissue rolls.

SUMMARY OF THE INVENTION

The present invention is a toilet accessory comprising a plunger cover having an elongate cylinder connected to a hollow lower housing with the cylinder having opposing top and bottom portions with an elongate cavity extending from the top portion through the bottom portion. The housing cavity is of sufficient diameter to removably receive an elongate toilet plunger handle. The cylinder has an outer diameter of sufficient size to removably receive thereon at least one roll of toilet paper having a hollow tubular core and the cylinder cavity communicates with a cavity of the hollow housing. The housing has a top wall and a connected side wall with the top wall extending radially outward from the outer diameter of the cylinder bottom portion and then connecting to a downwardly depending side wall. The side wall has a lower perimeter edge forming a base of the accessory. The cylinder and the housing are connected to form a unitary accessory adapted for substantially enclosing a toilet plunger.

The present invention further contemplates as a second separate component, a base plate. The base plate has a base surface and connected peripheral upstanding side wall lip whereby a plunger may be placed on the base plate to prevent direct contact with an exterior surface such as a floor and a plunger cover of the present invention may be placed over the plunger with the lower perimeter edge of the cover resting within the perimeter of the base plate. The plunger cover and base plate may be provided as a kit.

DETAILED DESCRIPTION OF THE INVENTION

Figure 1:
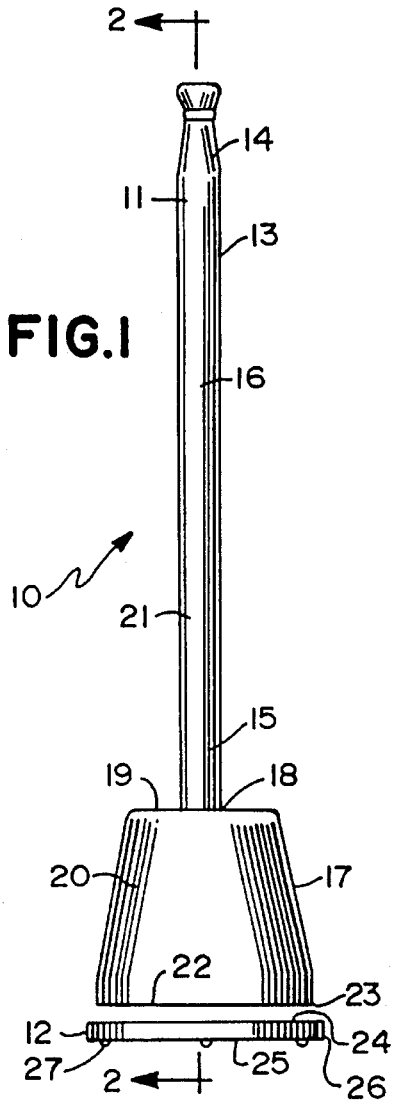
FIG. 1 is an exploded side view of a toilet accessory according to the present invention including a plunger cover and base plate.
Figure 7:
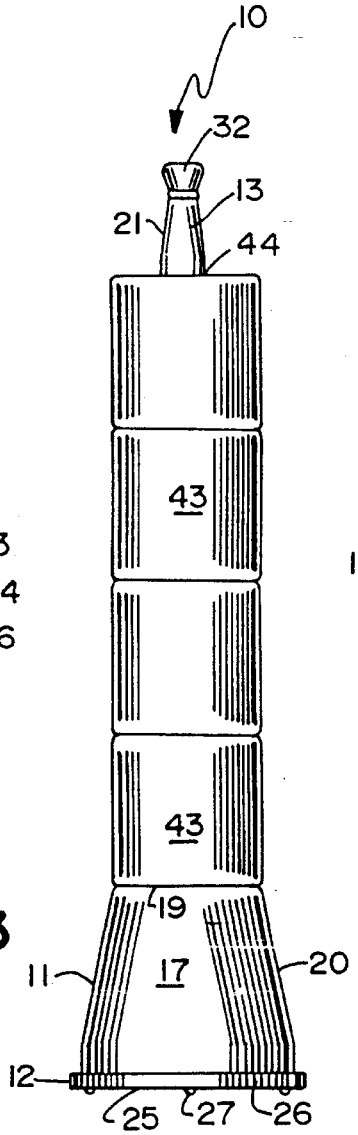
FIG. 7 is a side view of the inventive bathroom accessory storing a plurality of toilet tissue rolls.

Referring now to the drawings, FIG. 1 is an exploded side view of a toilet accessory 10 of the present invention. Accessory 10 comprises a plunger cover 11 and base plate 12. Plunger cover 11 has an elongate cylinder 13 (having opposing top portion 14 and bottom portion 15, respectively connected by a middle portion 16) connected to a lower housing 17. The plunger cover housing 17 is hollow and is connected to the bottom portion 15 of the cylinder 13 at intersection 18. Housing 17 has a top wall 19 connected to a downwardly depending side wall 20. Advantageously, the top wall 19 extends radially outward from an outer surface 21 of cylinder 13 at intersection 18. Preferably the top wall 19 and outer surface 21 are perpendicularly disposed thereby forming a right angle at intersection 18. This perpendicular junction advantageously provides proper support for removably stacked rolls of tissue as shown in FIG. 7. Advantageously, the elongate cylinder 13 and lower housing 17 are integrally connected at intersection 18 to form a unitary plunger cover 11. The cover 11 is adapted for substantially enclosing a toilet plunger. The side wall 20 is beneficially continuous about a longitudinal axis defined by elongate cylinder 13 and has a lower perimeter edge 22 forming a base 23. The lower perimeter edge 22 is preferably a continuous edge and is preferably planar. However, the lower perimeter edge 22 may be non-planar or have interruptions, slots, openings or other discontinuities to provide for increased air circulation to facilitate e.g. drying of a wet plunger. Similarly, outer surface 21 of cylinder 13, or top wall 19 or side wall 20 may have slots or openings to facilitate drying and/or air circulation.

While a plunger cover 11 may be adapted for substantially enclosing a suction type device such as the commonly known, household toilet plunger, a base plate 12 may optionally be provided to further enclose the plunger (See FIG. 2) and protect flooring surfaces. Use of the term "substantially enclosing" is not meant to preclude the opening defined by lower perimeter edge 22 since in normal use the cover will be set in an upright position with edge 22 against or adjacent to either a floor or base plate 12 or a similar structure. Furthermore, the term "substantially enclosing" is understood to contemplate and define cover 11 which may contain a plurality of optional slots, openings, holes or other passages to facilitate drying, air circulation and the like as described above.

The base plate 12 typically has a top surface 24 opposing bottom surface 25 and side wall 26. Bottom surface 25 may be equipped with stabilizing means such as a plurality of projections 27. Use of three projections 27 provides stable positioning on irregular surfaces.

The cover 11 and base plate 12 of the present invention may be constructed of wood, metal, fiberglass, or other known shape retaining materials by well known fabrication methods. Preferably, the accessory is formed of a durable polymer such as polystyrene, polypropylene or ABS by injection molding according to known techniques. Use of plastic molding allows for production of a variety of colors and/or molded textured surfaces to provide an aesthetically pleasing accessory which may be coordinated with common bathroom color schemes or other bathroom accessories.

Figure 2:
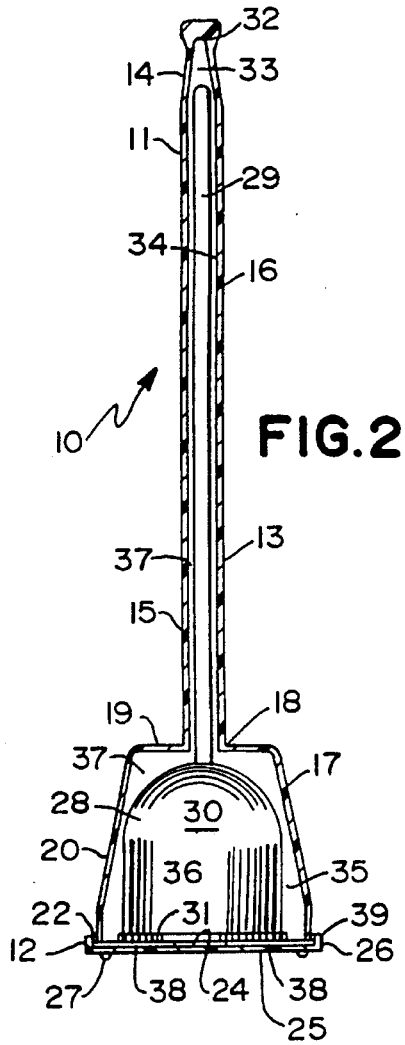
FIG. 2 is a cross-sectional view of the unexploded accessory of FIG. 1 taken along lines 2—2 with a contained plunger.

Referring now to FIG. 2, a cross-sectional view of the toilet accessory 10 of FIG. 1 is shown with the plunger cover 11 resting upon the base plate 12. For clarity a suction type device such as an ordinary toilet plunger 28 having a handle 29 and connected suction head 30 with lower rim 31 is shown in full side view rather than cross-section. The plunger cover 11 has an elongate cylinder 13 integrally connected to a lower housing 17 at intersection 18. The cylinder 13 has a closed end 32 located on its top portion 14 which may be used as a handle and beneficially may be ornamentally shaped. The cylinder 13 has an elongate cavity 33 (defined by interior cylinder surface 34) extending from the top portion 14, through the middle portion 16 and lower portion 15 and communicating with a lower housing cavity 35, formed by an interior surface 36 of integrally connected housing top wall 19 and side wall 20. Cylinder cavity 33 opens into housing cavity 35 to provide a continuous hollow space 37 defined by interior surfaces 34 and 36 which space 37 is adapted to removably receive and cover a suction type device such as toilet plunger 28. The elongate cylinder cavity 33 of hollow space 37 has a sufficiently large enough diameter to accommodate handle 29 while housing cavity 35 is sufficiently large enough to removably receive suction head 30.

The rim 31 of suction head 30 supports the plunger 28 upon a plurality of ribs 38 which extend upward from the top surface 24 of a base plate 12. The lower perimeter edge 22 of housing 17 also rests upon ribs 38 and inside a raised lip 39 of the upstanding side wall 26 of base plate 12. Projections 27 are located on the bottom surface 25 of base plate 12. The ribs 38 act to space the plunger cover 11 and plunger 28 apart from the top surface 24 of the base plate 12 to provide drainage of the plunger 28. It is contemplated that the plunger cover 11 will be withdrawn by hand with an upward motion to allow access to the covered plunger 28. After use, the plunger 28 may be replaced by a reverse procedure. Normal use of the plunger will wet the suction head 30 and possibly the handle 29. Advantageously, the present invention allows speedy replacement of the plunger upon the base with enclosure by the cover 11. Thus the wet plunger may be quickly hidden from view. Furthermore the base plate provides for drainage of the plunger into the base plate thus protecting the floor from unwanted contact with any liquid run off from the plunger. Also, the interior diameter of the raised lip 39 of the base plate 12 has a larger diameter than the outer diameter of the lower housing side wall 20 so that air may circulate in cooperation with the raised rib 38 and top surface 24 of the base plate 12 to facilitate drying, prevent mold, and dispel odors, etc.

Figure 3:
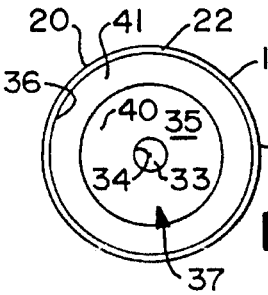
FIG. 3 is a bottom plan view of the plunger cover of the present invention.

Referring now to FIG. 3, a bottom view of the plunger cover 11 of FIG. 1 is shown. The lower perimeter edge 22 of housing 17 is preferably continuous and planar. The housing side wall 20 has an interior surface 36 having a bottom portion 40 of top wall 19 (see FIG. 1) and inner portion 41 of side wall 20 forming a lower housing cavity 35. Cavity 35 communicates with a cylinder cavity 33 formed by the interior surface 34 of the elongate cylinder 13 (see FIG. 1) to form hollow space 37. Advantageously, cavity 33 is of sufficient diameter to accommodate a plunger handle. Preferably, cavity 33 is elongate with a circular cross-section defined by surface 34. Also, perimeter edge 22 is preferably circular with lower housing 17 generally frusto-conical in shape thereby facilitating placement and removal of the cover over a commonly employed symmetrically shaped plunger.

Figure 4:
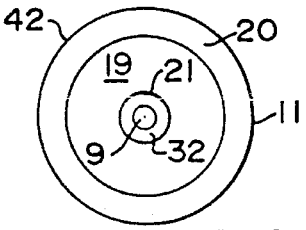
FIG. 4 is a top plan view of the plunger cover of FIG. 3.

Referring now to FIG. 4, a top view is show of a plunger cover 11 having a closed end 32, outer cylinder surface 21, a housing top wall 19, and housing side wall 20 with an outer housing surface 42. Advantageously, all outer surfaces are symmetrical and preferably circular in shape to provide pleasing esthetics and economy of materials and space. An optional vent opening 9 may be provided in the otherwise closed end 32 to communicate with the cylinder cavity 33 (see FIG. 2) in order to facilitate air circulation, drying, etc.

Figure 5:
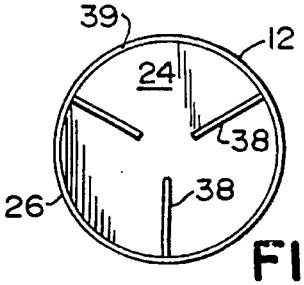
FIG. 5 is a top view of the base plate of the present invention.

Referring now to FIG. 5, a top view is presented of the base plate 12 having a top surface 24 with a plurality of integral raised ribs 38 all connected to a side wall 26 having a lip 39.

Figure 6:
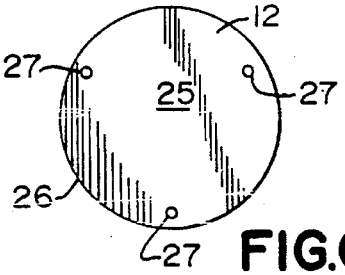
FIG. 6 is a bottom plan view of the base plate of FIG. 5.

Referring now to FIG. 6, a bottom view is presented of the base plate 12 of FIG. 5 having a bottom surface 25 with a plurality of integral stabilizing projections 27. Side wall 26 defines the perimeter edge of plate 12 and is preferably circular in shape.

Referring now to FIG. 7, a side view is shown of a toilet accessory 10 of the present invention. A plunger cover 11 rests upon a base plate 12 having a bottom surface 25 with attached projections 27 and a side wall 26. A generally frusto-conical lower housing 17 having a side wall 20 rests upon plate 12 and in turn supports a plurality of toilet tissue or toilet paper rolls 43 upon top wall 19. Rolls 43 are commonly known, commercially available products typically having a hollow, tubular core 44, generally made of paper. In operation cover 11 and plate 12 will enclose (or cover 11 alone will enclose) a plunger (see FIG. 2) and a plurality of toilet paper rolls 43 will be stacked on cover 11 by placing each roll core 44 over the elongate cylinder 13. The outer surface 21 of cylinder 13 is of sufficiently small diameter to accommodate standard roll core sizes for easy placement and removal of the rolls 43 upon the cover 11. The cylinder 13 has a closed end 32 which may be ornamental and functions with outer surface 21 as a handle for the cover.

Advantageously, the present invention provides an attractive accessory which may be placed near a toilet to provide a functional holder for a plurality of rolls of toilet tissue and a toilet plunger. Beneficially, a simple inexpensive, elegant device is provided which allows fast and ready access to a plunger and/or paper roll when needed, yet hides from view the plunger when not in use. A further advantage of the present invention is that drainage and/or suitable air flow may be provided for the plunger to offer the following advantages: (a) prevent slippery and dangerous bathroom floors; (b) reduce the opportunity for transmission of disease by confining fecal contaminated fluid to the inventive device and preventing drainage onto the bathroom floor; (c) allow display of "designer" bathroom tissue (toilet paper is now printed in a wide variety of colors and designs). The present invention unlike prior devices allows display of multiple rolls with attendant colors and/or designs); (d) prevention of contact between wet plunger components (including handle) and toilet tissue; (e) and allows easy removal of individual or plural rolls of paper.

In addition, the inner surface of the cover is preferably a continuous wall thereby providing a self guiding feature which facilitates insertion of the plunger handle so that the plunger may be easily and quickly covered. Providing a continuous wall also thoroughly Insulates the paper rolls from a wet plunger thereby preventing the deleterious and aesthetically undesirable effect of moisture upon the rolls either by direct contact, condensation or capillary action.

The present invention provides for the first time a bathroom accessory for covering a plunger and holding a plurality of stacked rolls of toilet tissue which may be conveniently located near a toilet and provide an attractive display in a minimum of space with speedy access and replacement of the plunger while preventing contact of the rolls with a wet plunger. In particular, slow moving or clogged toilet drains often require multiple but separate uses of a plunger in a relatively short period of time (possibly each consecutive flushing of the toilet until the clog dissipates or is removed). Therefore, it is a significant advantage to be able to continue to use the present device without necessitating removal of the rolls and/or placement of the plunger in a different location (e.g. away from the toilet) due to drainage of liquid from the plunger.

The above description, drawings and following claims are illustrative of the invention, but should not be taken as limiting the scope thereof, since modifications of these teachings and other advantages will be apparent to those skilled in the art in view of the present disclosure.

What is claimed is:

1. A toilet accessory comprising:

a plunger cover having an elongate cylinder connected to a hollow lower housing; said cylinder having opposing top and bottom portions with an elongate cavity extending from said top portion through said bottom portion, said cylinder cavity of sufficient diameter to removably receive an elongate toilet plunger handle and said cylinder having an outer diameter of sufficient size to removably receive thereon at least one roll of toilet paper having a hollow tubular core; said cylinder cavity communicating with a cavity of said hollow lower housing; said housing having a top wall and a connected side wall, said top wall extending radially outward from said outer diameter of said cylinder bottom portion and connected to a downwardly depending side wall, said side wall having a lower perimeter edge forming a base of said cover, said cylinder and said housing connected to form a unitary cover adapted for substantially enclosing a toilet plunger, said toilet accessory further comprising as a separate component a base plate having a base surface and connected peripheral upstanding side wall lip whereby said base plate is adapted for removably receiving thereon said plunger cover with said side wall lip of said base plate extending around said lower perimeter edge of said cover housing.

2. A toilet accessory, as defined in claim 1, (wherein said base surface of said base plate has a top surface and opposing bottom surface with at least one raised rib extending upward from said top surface.

* * * * *